US009499185B2

(12) United States Patent
Green et al.

(10) Patent No.: US 9,499,185 B2
(45) Date of Patent: Nov. 22, 2016

(54) WAYSIDE GUIDEWAY VEHICLE DETECTION AND SWITCH DEADLOCKING SYSTEM WITH A MULTIMODAL GUIDEWAY VEHICLE SENSOR

(71) Applicant: Thales Canada Inc, Toronto, Ontario (CA)

(72) Inventors: Alon Green, Toronto (CA); Firth Whitwam, Toronto (CA)

(73) Assignee: Thales Canada Inc, Toronto, Ontario (CA)

( * ) Notice: Subject to any disclaimer, the term of this patent is extended or adjusted under 35 U.S.C. 154(b) by 321 days.

(21) Appl. No.: 14/137,461

(22) Filed: Dec. 20, 2013

(65) Prior Publication Data

US 2015/0175179 A1 Jun. 25, 2015

(51) Int. Cl.

| | |
|---|---|
| ***B61L 25/00*** | (2006.01) |
| ***B61L 25/04*** | (2006.01) |
| ***B61L 19/06*** | (2006.01) |
| ***B61L 21/06*** | (2006.01) |

(52) U.S. Cl.
CPC ..... *B61L 25/045* (2013.01); *B61L 19/06* (2013.01); *B61L 21/06* (2013.01); *B61L 25/04* (2013.01); *B61L 25/048* (2013.01)

(58) Field of Classification Search
CPC ..... B61L 25/045; B61L 19/06; B61L 21/06; B61L 25/04; B61L 25/048
See application file for complete search history.

(56) References Cited

U.S. PATENT DOCUMENTS

| | | | |
|---|---|---|---|
| 5,330,136 A | 7/1994 | Colbaugh | |
| 6,032,905 A | 3/2000 | Haynie | |
| 6,371,417 B1 | 4/2002 | Southon | |
| 6,397,130 B1 * | 5/2002 | Carr | B61L 25/025 250/559.29 |
| 6,604,031 B2 | 8/2003 | Ohuma et al. | |
| 6,666,411 B1 | 12/2003 | Hart et al. | |
| 6,688,561 B2 | 2/2004 | Mollet et al. | |
| 6,732,023 B2 | 5/2004 | Sugita et al. | |
| 6,848,657 B2 | 2/2005 | Young et al. | |

(Continued)

FOREIGN PATENT DOCUMENTS

| | | |
|---|---|---|
| EP | 2390158 | 11/2011 |
| WO | 2011153114 | 12/2011 |

OTHER PUBLICATIONS

R. W. Ngigi et al., "Modem techniques for condition monitoring of railway vehicle dynamics", 251 International Congress on Condition Monitoring and Diagnostic Engineering, IOP 1-9 Publishing Journal of Physics; Conference Series 364 (2012) 012016.

(Continued)

*Primary Examiner* — Jason C Smith
(74) *Attorney, Agent, or Firm* — Hauptman Ham, LLP

(57) ABSTRACT

A multimodal guideway vehicle sensor includes a passive sensor, an active sensor and an unique identification (ID) sensor. The passive sensor is configured to receive and detect a first electromagnetic radiation from a guideway vehicle. The active sensor configured to transmit a second electromagnetic radiation and receive and detect the second electromagnetic radiation reflected from the guideway vehicle. The ID sensor that detects an ID associated with the guideway vehicle. The multimodal guideway vehicle sensor also includes a data fusion center that combines signals from the passive sensor, the active sensor and the ID sensor to produce guideway vehicle information about the guideway vehicle.

20 Claims, 6 Drawing Sheets

(56) References Cited

U.S. PATENT DOCUMENTS

| | | | | |
|---|---|---|---|---|
| 7,027,901 | B2 | 4/2006 | Oguma et al. | |
| 7,050,890 | B2 | 5/2006 | Tolmei | |
| 7,075,427 | B1 * | 7/2006 | Pace | B61L 23/06 246/125 |
| 7,092,800 | B2 | 8/2006 | Kane et al. | |
| 7,165,748 | B2 | 1/2007 | Ebuchi et al. | |
| 7,209,810 | B2 | 4/2007 | Meyer et al. | |
| 7,464,904 | B2 * | 12/2008 | Vehar | B61L 1/188 246/1 C |
| 7,593,963 | B2 | 9/2009 | Ballesty et al. | |
| 7,729,818 | B2 * | 6/2010 | Wheeler | B61L 3/127 246/167 R |
| 7,742,850 | B2 * | 6/2010 | Kane | B61L 15/0027 246/122 R |
| 7,840,338 | B2 | 11/2010 | Paolacci | |
| 8,073,581 | B2 * | 12/2011 | Morris | B61L 3/065 235/440 |
| 8,073,582 | B2 | 12/2011 | Kellner et al. | |
| 8,140,250 | B2 * | 3/2012 | Mian | B61L 27/0094 104/26.1 |
| 8,157,218 | B2 | 4/2012 | Riley et al. | |
| 8,157,219 | B2 | 4/2012 | Ashraf et al. | |
| 8,212,685 | B2 * | 7/2012 | LeFebvre | B61K 9/00 246/169 R |
| 8,231,270 | B2 | 7/2012 | Groeneweg et al. | |
| 8,245,983 | B2 | 8/2012 | Gilbertson | |
| 8,280,567 | B2 * | 10/2012 | Brand | B61L 3/127 246/293 |
| 8,296,065 | B2 | 10/2012 | Haynie et al. | |
| 8,297,558 | B2 | 10/2012 | O'Dell et al. | |
| 8,370,006 | B2 | 2/2013 | Kumar et al. | |
| 8,380,361 | B2 | 2/2013 | Evans | |
| 2005/0205719 | A1 | 9/2005 | Hendrickson et al. | |
| 2010/0258682 | A1 * | 10/2010 | Fries | B61L 3/121 246/1 C |
| 2011/0022253 | A1 * | 1/2011 | Chen | B61L 1/14 701/19 |
| 2011/0226909 | A1 * | 9/2011 | O'Dell | B61L 29/226 246/126 |
| 2011/0238241 | A1 * | 9/2011 | Brady | B61L 25/025 701/19 |
| 2012/0126065 | A1 * | 5/2012 | Smith | B61L 3/006 246/167 R |
| 2012/0277948 | A1 | 11/2012 | Noonan | |
| 2012/0286103 | A1 * | 11/2012 | Hilleary | B61L 23/041 246/125 |
| 2012/0325980 | A1 * | 12/2012 | Noffsinger | H04L 12/10 246/169 R |
| 2013/0018534 | A1 * | 1/2013 | Hilleary | B61L 27/00 701/19 |
| 2013/0018536 | A1 * | 1/2013 | Cooper | B61L 3/008 701/20 |
| 2015/0175178 | A1 * | 6/2015 | Ignatius | B61L 15/0063 246/120 |
| 2015/0175179 | A1 * | 6/2015 | Green | B61L 19/06 246/27 |

OTHER PUBLICATIONS

A. M irabadi et al. ,"Fault detection and Isolation in Multisensor Train Navigation Systems", UKACC International Conference on Control '98, Sep. 1-4, 1998, Conference Publication No. 455, IEE, 1998.

International Search Report for corresponding International Application No. PCT/IB2014/063529, dated Nov. 7, 2014.

VKACC International Conference on Control '98, Sep. 1-4, 1998, Conference Publication, No. 455, IEE, 1998.

A Lancia et al., "Integrated multifunction system for the wayside detection of defects and hazardous conditions in rolling stock approaching critical tunnels," Heuristics GmbH, Vaglio, Switzerland; 2Elsag SpA, Genova, Italy, 2008, <http://www.uic.org/cdrom/2008/11_wcrr2008/pdf/R.2.1.5.2.pdf>.

Mazzino, "Wayside Monitoring Trains and Infrastructures: Information Management in a Railway Control Centre," Ansaldo STS, 2012, <www.sose2012.eu/docs/SOSE%202012_rev03.pdf>.

Broquetas et al., "Track Detection in Railway Sidings Based on MEMS Gyroscope Sensors," Department of Signal Theory and Communications, Universitat Politècnica de Catalunya, Spain, 2012, <www.mdpi.com/1424-8220/12/12/16228/pdf>.

A Acharya et al., "Train localization and parting detection using data fusion," Jadavpur University, Kolkata, India, 2011, <http://www.sciencedirect.com/science/article/pii/S0968090X10000367>.

* cited by examiner

WAYSIDE GUIDEWAY VEHICLE DETECTION AND SWITCH DEADLOCKING SYSTEM WITH A MULTIMODAL GUIDEWAY VEHICLE SENSOR

BACKGROUND

Current state of the art in train detection systems is based on track circuits or axle counting blocks that detect a presence of an object or objects, assumed to be a train or trains, within a certain predefined guideway area. The objects are tracked based on the track circuits and/or axle counting that block's occupancies. A guideway switch is deadlocked, i.e., a switch move is prevented, if the track circuit and/or axle counting area associated with the switch is occupied. These technologies are expensive and have numerous shortcomings.

BRIEF DESCRIPTION OF THE DRAWINGS

One or more embodiments are illustrated by way of example, and not by limitation, in the figures of the accompanying drawings, wherein elements having the same reference numeral designations represent like elements throughout. It is emphasized that, in accordance with standard practice in the industry various features may not be drawn to scale and are used for illustration purposes only. In fact, the dimensions of the various features in the drawings may be arbitrarily increased or reduced for clarity of discussion.

DETAILED DESCRIPTION

The following disclosure provides many different embodiments, or examples, for implementing different features of the invention. Specific examples of components and arrangements are described below to simplify the present disclosure. These are examples and are not intended to be limiting.

With considerable inherent uncertainty and unreliability issues, current technologies employ expensive wayside equipment to imply the presence or absence of a train or trains within a block, but still do not provide a reliable positive identification of such a train or trains. The lack of a more certain identification gives rise to numerous problems associated with false positives and false negatives. This is especially true for non-communicative trains. Trains can be non-communicative for a number of reasons including failure to install communications equipment, defective or damaged communications equipment, adverse external conditions, differing communication standards, etc. Embodiments of the invention provide more cost-effective, certain and reliable guideway vehicle identification entering or exiting a guideway block, including guideway switch deadlocking for non-communicating trains with positive train identification.

The wayside train detection and switch deadlocking with positive train identification application includes one or more multimodal guideway vehicle sensors. The multimodal guideway vehicle sensor ("fusion sensor") includes three main components, i.e., a passive sensor, an active sensor and a unique identification code (ID) sensor that detects a unique ID associated with a guideway vehicle. In addition to the unique ID, the multimodal guideway vehicle sensor detects and determines guideway vehicle position, velocity and direction of travel. In some embodiments, each of guideway vehicle ID, guideway vehicle position, velocity and direction of travel are sensed by at least two different sensors. Data from the at least two different sensors is weighted and combined to form guideway vehicle information or "fusion data," to provide far greater certainty and reliability in a cost-effective manner. Fusion data is used in some embodiments to enable more certain and reliable wayside train detection and switch deadlocking with positive train identification. In some embodiments the guideway vehicle is a train, however, the type of guideway vehicle is not restricted to trains and includes a variety of other equipment including guideway servicing vehicles and guideway testing vehicles. In some embodiments the guideway vehicle is non-communicative, however, in some embodiments the guideway vehicle is communicative.

Figure 1:
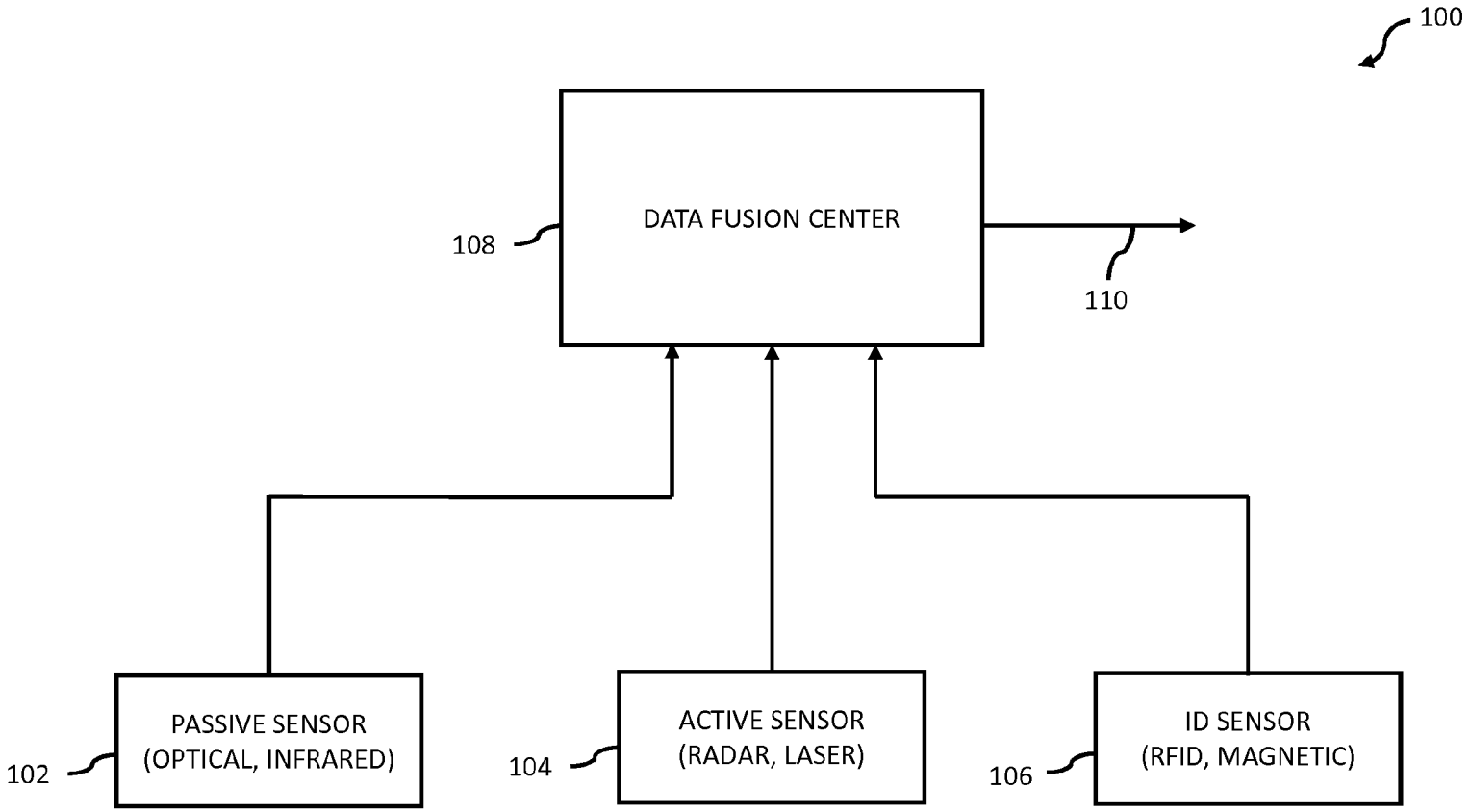
FIG. 1 is a block diagram of a multimodal guideway vehicle sensor in accordance with some embodiments as applied to a wayside train detection and switch deadlocking with positive train identification application.

FIG. 1 is a block diagram of a multimodal guideway vehicle sensor 100 in accordance with some embodiments as applied to a wayside train detection and switch deadlocking with positive train identification application. The multimodal guideway vehicle sensor 100 includes a passive sensor 102, an active sensor 104 and a unique identification code (ID) sensor 106. In some embodiments, the passive sensor 102 includes an optical camera that detects and tracks guideway vehicles based on an object image generated by the visible part of the electromagnetic spectrum emitted/reflected by the objects. In some embodiments, the passive sensor 102 is an infrared camera that detects and tracks guideway vehicles based on an object image generated by the infrared or thermal part of the electromagnetic spectrum emitted/reflected by the objects. The passive sensor 102 detects guideway vehicle position, speed and direction of travel. Note that in some embodiments, position information includes identification of which track a train is traveling on. In some embodiments, the passive sensor 102 can also detect an unique identification code (ID) associated with the guideway vehicle. In some embodiments, the ID is displayed in an optically visible "license plate" type format using alphanumeric characters that are printed on the guideway vehicle or on a separate license plate. The optical camera receives the pattern and performs optical character recognition (OCR) on the pattern to determine the ID code. In some embodiments, the infrared camera receives and infrared pattern and performs character recognition on the pattern to determine the ID code. In general, the passive sensor 102 is passive in the sense that it does not emit the electromagnetic radiation it is receiving, as opposed to the active sensor 104, which does emit the electromagnetic radiation it is receiving.

In some embodiments, the active sensor 104 is a radar-based sensor that detects and tracks guideway vehicles based on reflected waves in the microwave portion or radio portion of the electromagnetic spectrum. In some embodiments, the active sensor 104 is a laser-based sensor that detects and tracks the guideway vehicles based on the reflected laser light waves in the optical portion or infrared portion of the electromagnetic spectrum. Similar to the passive sensor 102, the active sensor 104 detects guideway vehicle position, speed and direction of travel. In some embodiments, the active sensor 104 can also detect an ID associated with the guideway vehicle. For example a license plate or bar code type object carried by guideway vehicles contains an ID code capable of being sensed by the active sensor 104.

In some embodiments, the ID sensor 106 includes a radio frequency ID (RFID) sensor, such as an RFID reader, that uses waves in the microwave portion or radio portion of the electromagnetic spectrum to wirelessly sense IDs of guideway vehicles stored in RFID devices (tags) carried by the guideway vehicles. The RFID tags each transfer their stored ID as data that is received by the RFID sensor 106, for the purposes of automatically identifying and tracking guideway vehicles. Some RFID tags are powered by and read at short ranges (on the order of meters) via electromagnetic induction, to act as a passive transponder and emit waves in the radio portion or microwave portion of the electromagnetic spectrum. In some embodiments, RFID tags use a local power source on guideway vehicles, such as a battery, and operate reliably at hundreds of meters. Unlike a bar code, the RFID tag does not necessarily need to be within line of sight of the reader, and may be embedded within the guideway vehicle. In some embodiments, the RFID sensor 106 can sense RFID tags of guideway vehicles that are active, power-assisted passive or passive. An active RFID tag has an on-board power supply and periodically transmits its ID signal. A power-assisted passive RFID tag is connected to a power source and is activated by the RFID sensor 106. A passive RFID tag is activated and powered by the RFID sensor 106.

In some embodiments, the ID sensor 106 includes a magnetic proximity sensor that detects the presence of metal objects in proximity to a magnetic field associated with the magnetic proximity sensor. The unique ID associated with the guideway vehicle is represented in a pattern of metal objects. Similar to an RFID sensor, a magnetic proximity sensor senses an ID associated with a guideway vehicle. In some embodiments, each ID is associated with a separate guideway vehicle by installing multiple metal objects on each guideway vehicle each having a unique detection pattern corresponding to the ID of that guideway vehicle.

Although the ID sensor 106 is able to sense an ID associated with a guideway vehicle, in some embodiments, the ID sensor also indirectly detects position, speed and direction of travel of that guideway vehicle.

Information sensed by the passive sensor 102, active sensor 104 and ID sensor 106 regarding guideway vehicle position, speed and direction of travel as well as guideway vehicle ID is transmitted to a data fusion center 108. Data from the sensors 102, 104, 106 directly or indirectly enable the data fusion center 108 to provide guideway vehicle information 110 on guideway vehicle type (such as a train), guideway vehicle ID, position (including track and distance to frontmost end of approaching guideway vehicle or distance to rearmost end of receding guideway vehicle), relative speed between the guideway vehicle and sensors, guideway vehicle travel direction (approaching or receding), an elevation angle to the guideway vehicle in the sensor's body coordinates, for example, to help confirm the detected object is a train, and a heading angle, for example, to help confirm direction of travel, and in some embodiments, a video image of all or a portion of the guideway vehicle. In some embodiments, the data fusion center 108 receives data from two or more of the sensors 102, 104, 106 that is weighted and combined (fused) to produce the guideway vehicle information 110. For example, while the ID sensor 106 provides an indication of train position, data from the active sensor 104, using transmitted radar or laser, receives greater weight in some embodiments.

Figure 2:
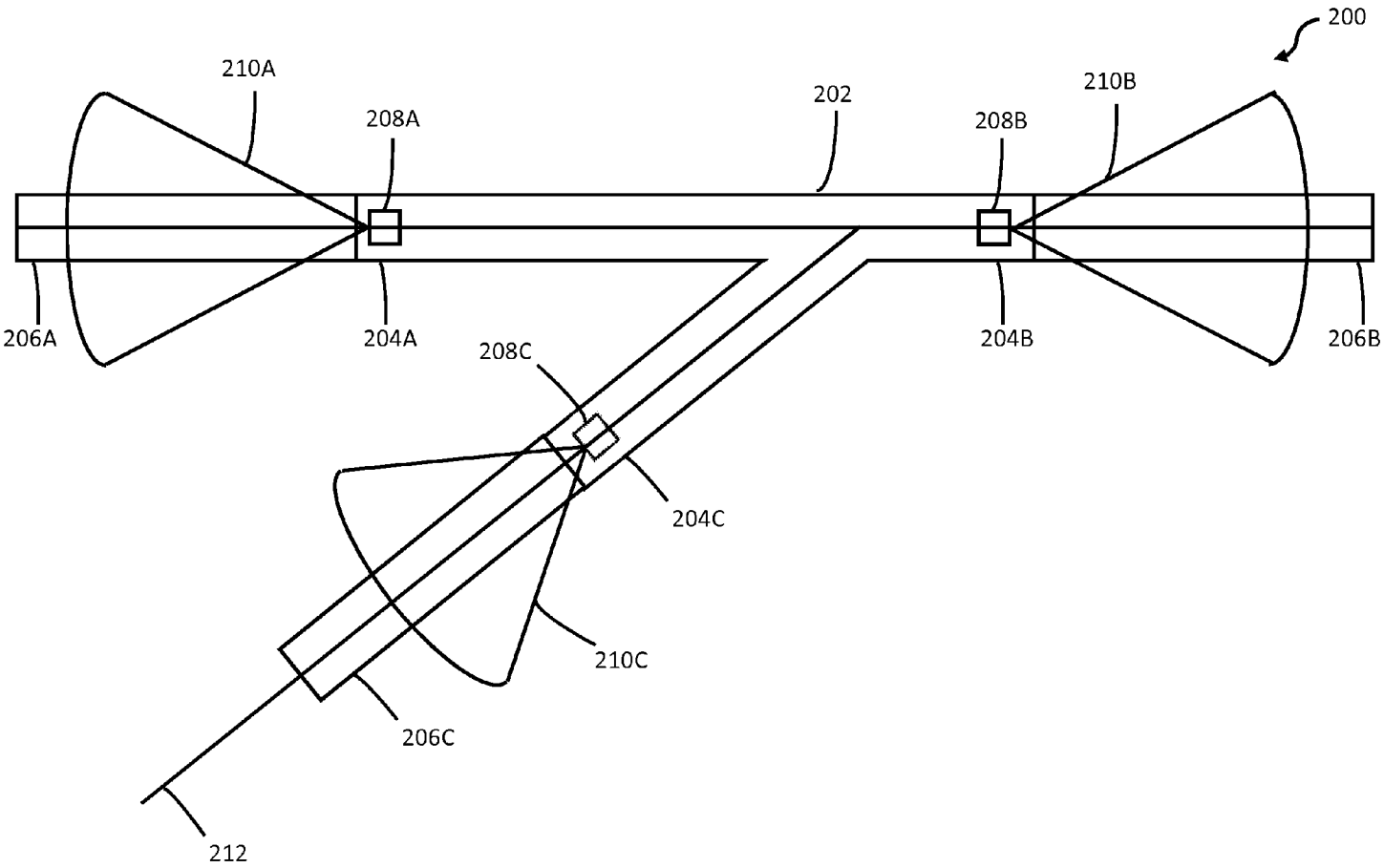
FIG. 2 is a block diagram of a switch area portion of a multimodal wayside guideway vehicle detection and switch deadlocking system in accordance with some embodiments.

FIG. 2 is a block diagram of a switch area 202 portion of a multimodal wayside guideway vehicle detection and switch deadlocking system 200 in accordance with some embodiments. In some embodiments, the switch area 202 forms a Y-like shape having three fouling points (switch area end points) 204A, 204B, 204C. Each of the switch area end points 204A, 204B, 204C is physically coupled to guideway portions 206A, 206B, 206C of the guideway vehicle detection and switch deadlocking system 200, respectively. Multimodal guideway vehicle sensors 208A, 208B, 208C are positioned adjacent to switch area end points 204A, 204B, 204C, respectively. Each of the multimodal guideway vehicle sensors 208A, 208B, 208C has a detection envelope 210A, 212B, 212C, respectively. Each detection envelope 210A, 212B, 212C represents the detection area of the multimodal guideway vehicle sensors 208A, 208B, 208C for detecting guideway vehicles traveling on a guideway 212. In some embodiments, each detection envelope 210A, 212B, 212C extends approximately 350 meters out of the multimodal guideway vehicle sensors 208A, 208B, 208C, respectfully, and encompasses an angle of approximately 60 degrees. The detection envelopes 210A, 212B, 212C are arranged on the switch area end points 204A, 204B, 204C, respectively to monitor all guideway vehicle traffic entering and exiting the switch area 202. All guideway vehicle traffic entering and exiting the switch area 202 is monitored at least in part because a guideway vehicle, such as a train, is potentially diverted from one guideway branch to another guide branch. Tracking guideway vehicles that divert from one guideway branch to another guide branch is useful for preventing problems with the guideway. Furthermore, by monitoring if a guideway vehicle such as a train is occupying the switch area 202, the switch area is prevented from switching (deadlocked), enabling the smooth passage of the train.

Figure 3:
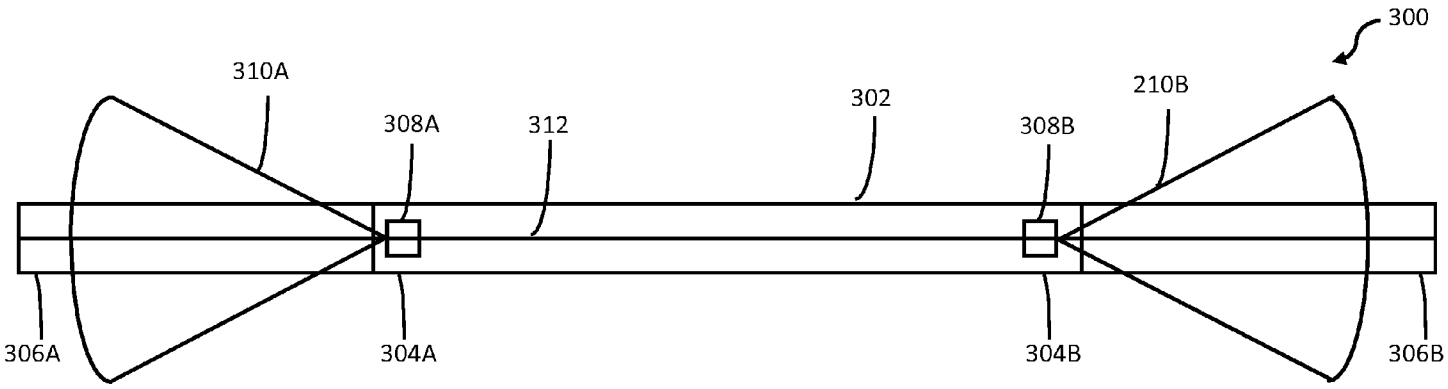
FIG. 3 is a block diagram of a platform area portion of a multimodal wayside guideway vehicle detection and switch deadlocking system in accordance with some embodiments.

FIG. 3 is a block diagram of a platform area 302 portion of a multimodal wayside guideway vehicle detection and switch deadlocking system 300 in accordance with some embodiments. In some embodiments, the platform area 302 forms a linear shape having two fouling points (platform area end points) 304A, 304B. Each of the platform area end points 304A, 304B is physically coupled to guideway portions 306A, 306B of the guideway vehicle detection and switch deadlocking system 300, respectively. Multimodal guideway vehicle sensors 308A, 308B are positioned adjacent to platform area end points 304A, 304B respectively. Each of the multimodal guideway vehicle sensors 308A, 308B has a detection envelope 310A, 310B respectively. Each detection envelope 310A, 312B represents the detection area of the multimodal guideway vehicle sensors 308A, 308B for detecting guideway vehicles traveling on a guideway 312. The detection envelopes 310A, 312B are arranged on the platform area end points 304A, 304B respectively to monitor all guideway vehicle traffic entering and exiting the platform area 302. All guideway vehicle traffic entering and exiting the platform area 302 is monitored at least in part because a guideway vehicle, such as a train, is potentially stopped or passing through the platform area and sensed information about the presence of a guideway vehicle, such as a train, is useful for preventing problems with the guideway network in general and in the platform area 202 in specific.

Figure 4:
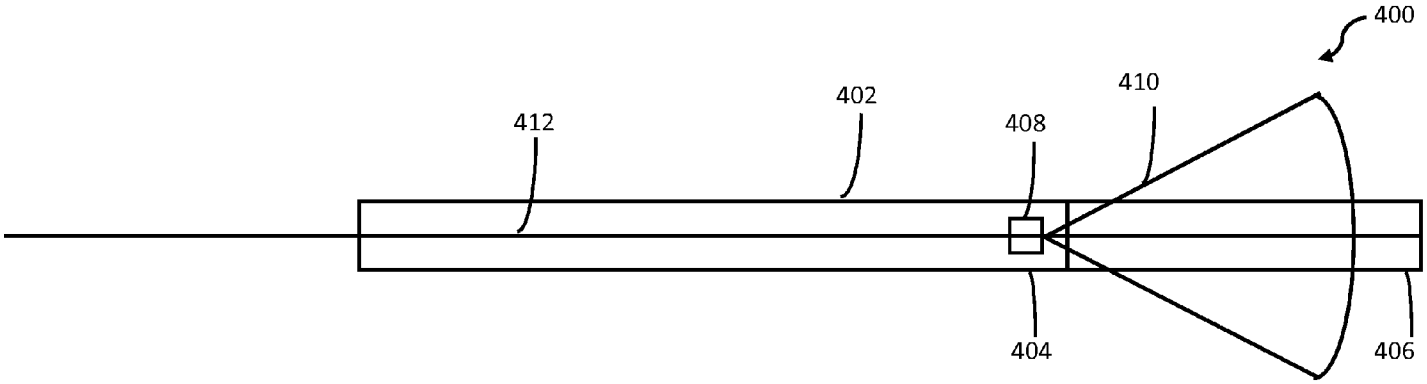
FIG. 4 is a block diagram of a transition area portion of a multimodal wayside guideway vehicle detection and switch deadlocking system in accordance with some embodiments.

FIG. 4 is a block diagram of a transition area 402 portion of a multimodal wayside guideway vehicle detection and switch deadlocking system 400 in accordance with some embodiments. In some embodiments, the transition area 402 forms a vector shape having one fouling point (transition area end point) 404. The transition area end point 404 is physically coupled to guideway portion 406 of the guideway vehicle detection and switch deadlocking system 400. Multimodal guideway vehicle sensor 408 is positioned adjacent to transition area end point 404. The multimodal guideway vehicle sensor 408 has a detection envelope 410. The detection envelope 410 represents the detection area of the multimodal guideway vehicle sensor 408 for detecting guideway vehicles traveling on a guideway 412. The detection envelope 410 is arranged on the transition area end point 404 to monitor all guideway vehicle traffic entering and exiting the transition area 402. The transition area 402 forms a boundary with guideway portion 406 which is part of a signaling system territory different from that of the transition area 402. In some embodiments, the guideway portion 406 is outside of the multimodal wayside guideway vehicle detection and switch deadlocking system 400. All guideway vehicle traffic entering and exiting the transition area 402 is monitored at least in part because a guideway vehicle, such as a train, is potentially or actually passing through the transition area and sensed information about the presence of a guideway vehicle, such as a train, is useful for preventing problems with the guideway network in general and in the transition area 402 in specific.

Figure 5:
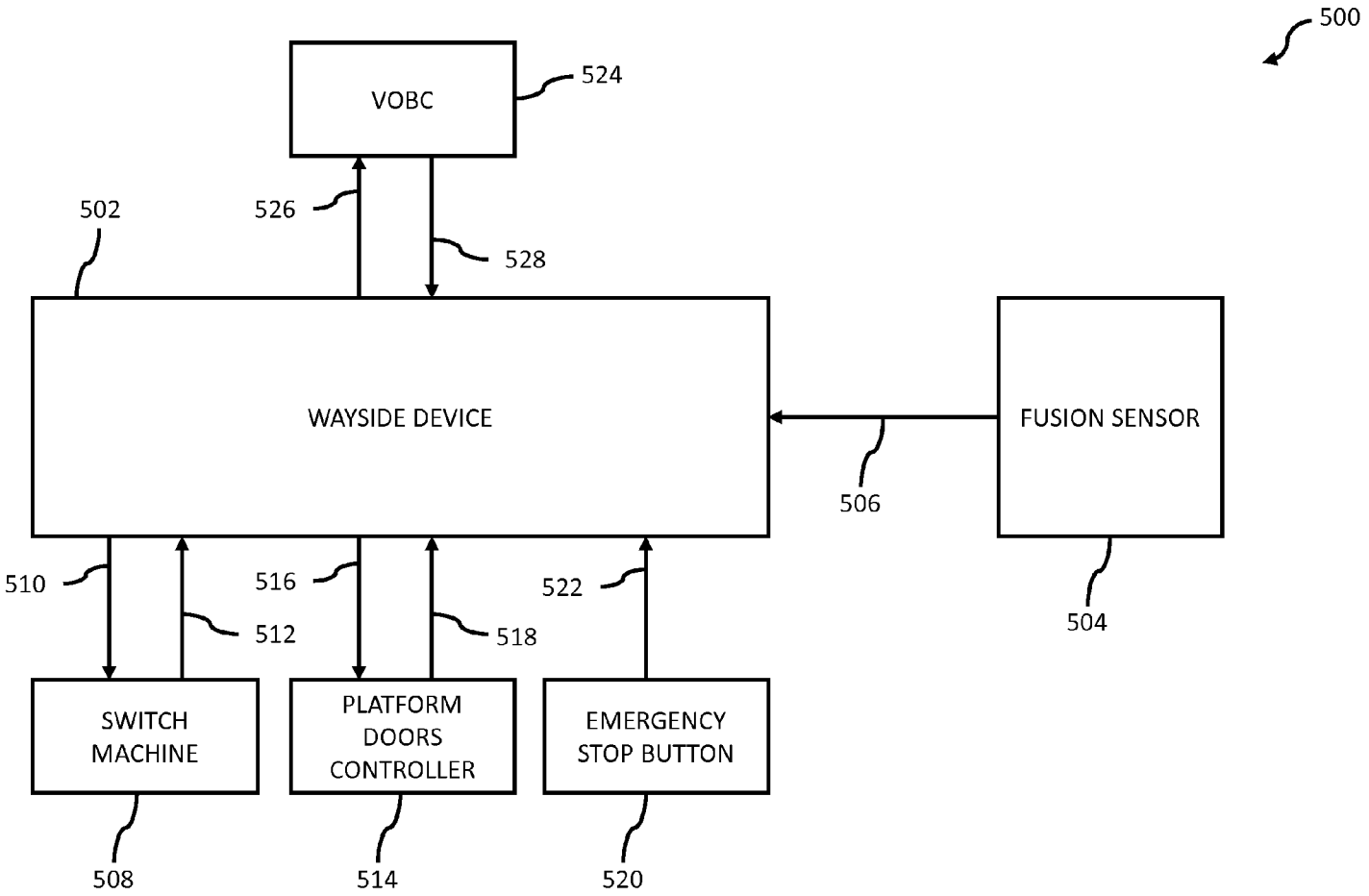
FIG. 5 is a block diagram of a wayside device in a multimodal wayside guideway vehicle detection and switch deadlocking system in accordance with some embodiments.

FIG. 5 is a block diagram of a wayside device (WD) 502 in a multimodal wayside guideway vehicle detection and switch deadlocking system 500 in accordance with some embodiments. In some embodiments, a multimodal guideway vehicle ("fusion") sensor 504 is electrically coupled to the wayside device 502. In some embodiments, the multimodal guideway vehicle sensor 504 is mounted onto the wayside device 502. In some embodiments, the multimodal guideway vehicle sensor 504 transmits guideway vehicle information 506 on guideway vehicle type (such as a train), guideway vehicle ID, position (including track and distance to frontmost end of approaching guideway vehicle or distance to rearmost end of receding guideway vehicle), relative speed between the guideway vehicle and sensors, guideway vehicle travel direction (approaching or receding), an elevation angle to the guideway vehicle in the sensor's body coordinates, for example, to help confirm the detected object is a train, and a heading angle, for example, to help confirm direction of travel, sensor status, and in some embodiments, a video image of all or a portion of the guideway vehicle.

In some embodiments, the wayside device 502 is communicatively coupled to a switch machine 508. Commands 510 are transmitted from the wayside device 502 to the switch machine 508. Status data 512 is received by the wayside device 502 from the switch machine 508. The switch machine 508 receives commands 510 and transmits status data 512 pertaining to operation of a guideway switch.

In some embodiments, the wayside device 502 is communicatively coupled to a platform doors controller 514. Commands 516 are transmitted from the wayside device 502 to the platform doors controller 514. Status data 518 is received by the wayside device 502 from the platform doors controller 514. The platform doors controller 514 receives commands 516 and transmits status data 518 pertaining to operation of platform doors.

In some embodiments, the wayside device 502 is communicatively coupled to an emergency stop button 520. Status data 522 from the emergency stop button 520, specifically, the emergency stop button's state of being active (depressed) or inactive (not depressed), is transmitted from the emergency stop button to the wayside device 502. Upon receipt of status data 522 from the emergency stop button 520, the wayside device issues corresponding status to a vehicle on-board controller (VOBC) 524 to initiate an emergency stop process.

The wayside device 502 transmits data 526 to the VOBC 524 and receives data 528 from the VOBC. In some embodiments, the VOBC 524 includes a transmitter/receiver for bidirectional wireless communication with the wayside device 502, a power supply and peripheral devices including a driver console having one or more displays. Data 526, 528 exchanged between the wayside device 502 and VOBC 524 enable more reliable monitoring and control of guideway vehicles. In some embodiments, data 526, 528 includes guideway vehicle information 506, switch identification, identification of multimodal guideway vehicle sensor 504, position and reservation status, platform doors identification and open/closed status. The multimodal guideway vehicle sensor 504 performs more reliable detection, identification and tracking of guideway vehicles, such as trains, is integrated into the wayside device 502 as described to control switches and other devices such as platform doors installed in the platform.

In some embodiments, guideway vehicle information 506 received from the multimodal guideway vehicle sensor 504 is used by the wayside device 502 to deadlock at least one switch upon an unequipped or non-communicating train approaching and/or occupying the switch area. In some embodiments, guideway vehicle information 506 received from the multimodal guideway vehicle sensor 504 is used by the wayside device 502 to unlock switches upon an unequipped or non-communicating train receding from and being outside a switch area. In some embodiments, guideway vehicle information 506 received from the multimodal guideway vehicle sensor 504 is used by the wayside device 502 to identify an unequipped or non-communicating train entry into and/or exit from the switch area 202, platform area 302 and/or transition area 402, as illustrated in FIGS. 2, 3 and 4, respectively.

Figure 6:
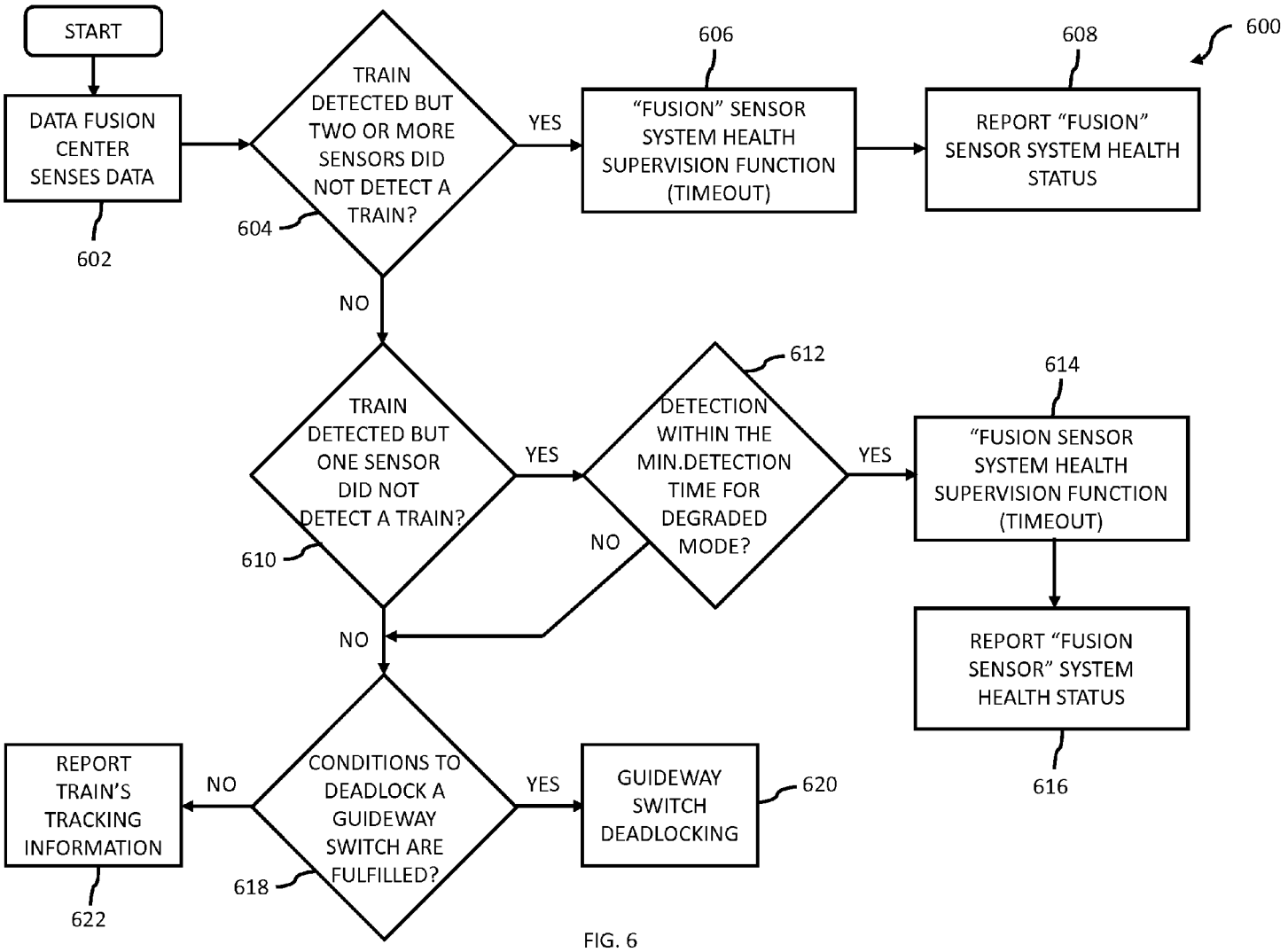
FIG. 6 is a flow chart of a wayside guideway vehicle detection and switch deadlocking system with a multimodal guideway vehicle sensor in accordance with some embodiments.

FIG. 6 is a flow chart of a method for providing a wayside guideway vehicle detection and switch deadlocking system with a multimodal guideway vehicle ("fusion") sensor 600 in accordance with some embodiments. For example, the wayside guideway vehicle detection and switch deadlocking system deadlocks switches, performs timeouts and administers sensor heath status checks, depending on guideway vehicle information received from a multimodal guideway vehicle sensor. The passive sensor, active sensor and ID sensor all have a maximum time in which to detect a guideway vehicle, such as a train. In some embodiments where trains are frequently observed, four hours is given to detect a train at a platform area or transition area. In some embodiments where trains are infrequently observed, 168 hours is given to detect a train detect a train at a platform area or transition area. Failure to detect a train within the maximum time results in the passive sensor, active sensor and/or ID sensor receiving a status of "failed," indicating an unacceptable or "unhealthy" condition. To ensure that such sensor failures are not accumulated, in some embodiments, if a sensor failure is detected the remaining sensors must detect a train within a shortened period of time, e.g., one hour, or the entire multimodal guideway vehicle sensor is assigned a status of "failed."

In operation 602 a data fusion center in multimodal guideway vehicle sensor 600 receives sensed data, weights and combines the sensed data to produce guideway vehicle information, and transmits the guideway vehicle information to a wayside device. In operation 604 the system with a multimodal guideway vehicle sensor 600 queries whether a guideway vehicle, such as a train, was detected by at least one sensor, but two or more sensors in the multimodal guideway vehicle sensor failed to detect a train within the maximum detection time. If operation 604 is "true," in operation 606 a supervisor function timeout cross checks sensor data against expected data ranges to determine if the passive sensor, the active sensor and/or the ID sensor is outputting sensor data outside the expected data range and, if so, changes the status of that sensor to "failed" indicating an unhealthy condition. In operation 608, results of operation 606 are reported to the wayside device.

If operation 604 is "false," in operation 610 the system with a multimodal guideway vehicle sensor 600 queries whether a guideway vehicle, such as a train, was detected by at least one sensor and one sensor in the multimodal guideway vehicle sensor failed to detect the train within the maximum time period. If operation 610 is "true," in operation 612 the system with a multimodal guideway vehicle sensor 600 queries whether a guideway vehicle, such as a train, was detected within a shortened or minimized maximum time period by at least one sensor. If a detection was made within the shortened maximum time period, operation 612 is "true" and in operation 614 a supervisor function timeout cross checks sensor data against expected data ranges to determine if the passive sensor, the active sensor and/or the ID sensor is outputting sensor data outside the expected data range and, if so, changes the status of that sensor to "failed" indicating an unhealthy condition. In operation 616, results of operation 614 are reported to the wayside device.

If operation 610 is "false" or operation 612 is false, in operation 618 the system with a multimodal guideway vehicle sensor 600 queries whether the conditions for deadlocking a switch are exist. If so, in operation 620 the switch is deadlocked, if not, in operation 622 the guideway vehicle information is reported to the wayside device.

Figure 7:
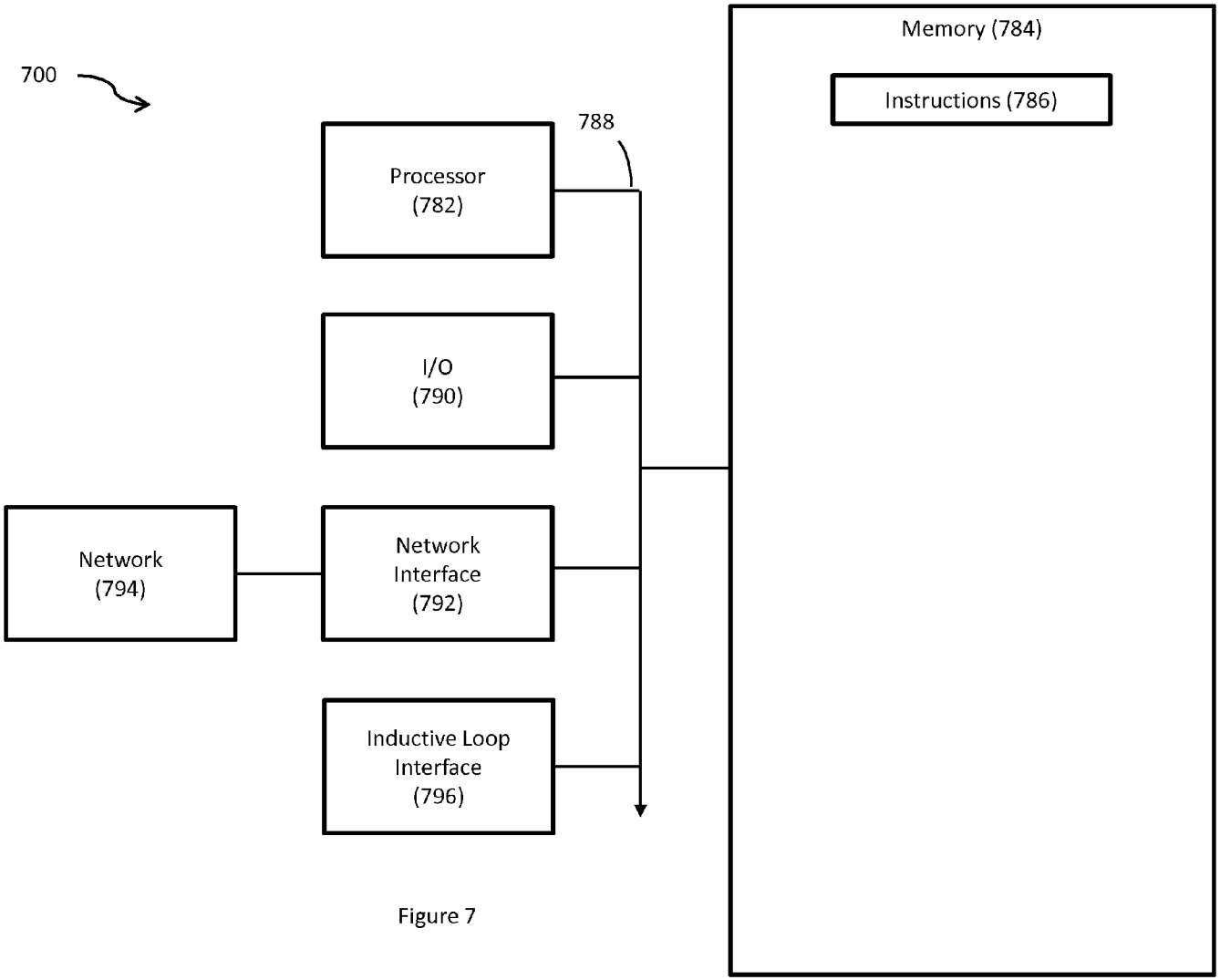
FIG. 7 is a block diagram of a computer system portion of a wayside guideway vehicle detection and switch deadlocking system with a multimodal guideway vehicle sensor in accordance with some embodiments.

FIG. 7 is a block diagram of a computer system portion 700 of a wayside guideway vehicle detection and switch deadlocking system with a multimodal guideway vehicle sensor in accordance with some embodiments. In some embodiments, the computer system 700 is part of the multimodal guideway vehicle sensor 100 (FIG. 1). In other embodiments, the computer system 700 is part of the wayside device 502 (FIG. 5). In still other embodiments, the computer system 700 is part of the VOBC 524 (FIG. 5). Computer system 700 includes a hardware processor 782 and a non-transitory, computer readable storage medium 784 encoded with, i.e., storing, the computer program code 786, i.e., a set of executable instructions. The processor 782 is electrically coupled to the computer readable storage medium 784 via a bus 788. The processor 782 is also electrically coupled to an I/O interface 790 by bus 708. A network interface 792 is also electrically connected to the processor 702 via bus 788. Network interface 792 is connected to a network 794, so that processor 782 and computer readable storage medium 784 are capable of connecting and communicating to external elements via network 794. An inductive loop interface 796 is also electrically connected to the processor 782 via bus 788. Inductive loop interface 796 provides a diverse communication path from the network interface 792. In some embodiments, inductive loop interface 796 or network interface 792 are replaced with a different communication path such as optical communication, microwave communication, or other suitable communication paths. The processor 782 is configured to execute the computer program code 786 encoded in the computer readable storage medium 784 in order to cause computer system 700 to be usable for performing a portion or all of the operations as described with respect to the wayside guideway vehicle detection and switch deadlocking system with a multimodal guideway vehicle sensor (FIGS. 1-6).

In some embodiments, the processor 782 is a central processing unit (CPU), a multi-processor, a distributed processing system, an application specific integrated circuit (ASIC), and/or a suitable processing unit.

In some embodiments, the computer readable storage medium 784 is an electronic, magnetic, optical, electromagnetic, infrared, and/or a semiconductor system (or apparatus or device). For example, the computer readable storage medium 784 includes a semiconductor or solid-state memory, a magnetic tape, a removable computer diskette, a random access memory (RAM), a read-only memory (ROM), a rigid magnetic disk, and/or an optical disk. In some embodiments using optical disks, the computer readable storage medium 784 includes a compact disk-read only memory (CD-ROM), a compact disk-read/write (CD-R/W), a digital video disc (DVD) and/or Blu-Ray Disk.

In some embodiments, the storage medium 784 stores the computer program code 486 configured to cause computer system 700 to perform the operations as described with respect to the multimodal guideway vehicle sensor 100 (FIG. 1), the wayside device 502 (FIG. 5), and the VOBC 524 (FIG. 5).

In some embodiments, the storage medium 784 stores instructions 786 for interfacing with external components. The instructions 786 enable processor 782 to generate operating instructions readable by the external components to effectively implement the operations as described with respect to the wayside guideway vehicle detection and switch deadlocking system with a multimodal guideway vehicle sensor.

Computer system 700 includes I/O interface 790. I/O interface 790 is coupled to external circuitry. In some embodiments, I/O interface 790 includes a keyboard, keypad, mouse, trackball, trackpad, and/or cursor direction keys for communicating information and commands to processor 782.

Computer system 700 also includes network interface 792 coupled to the processor 782. Network interface 792 allows computer system 700 to communicate with network 794, to which one or more other computer systems are connected. Network interface 792 includes wireless network interfaces such as BLUETOOTH, WIFI, WIMAX, GPRS, or WCDMA; or wired network interface such as ETHERNET, USB, or IEEE-1394.

Computer system 700 also includes inductive loop interface 796 coupled to the processor 782. Inductive loop interface 796 allows computer system 700 to communicate with external devices, to which one or more other computer systems are connected. In some embodiments, the operations as described above are implemented in two or more computer systems 700

Computer system 700 is configured to receive information related to the instructions 786 through I/O interface 710. The information is transferred to processor 782 via bus 788 to determine corresponding adjustments to the transportation operation. The instructions are then stored in computer readable medium 784 as instructions 786.

Some embodiments include a multimodal guideway vehicle sensor. The multimodal guideway vehicle sensor includes a passive sensor configured to receive and detect a first electromagnetic radiation from a guideway vehicle. The multimodal guideway vehicle sensor further includes an active sensor configured to transmit a second electromagnetic radiation and receive and detect the second electromagnetic radiation reflected from the guideway vehicle. The multimodal guideway vehicle sensor includes still further includes an unique identification code (ID) sensor that detects an ID associated with the guideway vehicle. The multimodal guideway vehicle sensor also includes a data fusion center that combines signals from the passive sensor, the active sensor and the ID sensor to produce guideway vehicle information about the guideway vehicle.

Some embodiments include a guideway vehicle detection system. The guideway vehicle detection system includes a wayside device. The guideway vehicle detection system further includes a multimodal guideway vehicle sensor electrically coupled to the wayside device, the multimodal guideway vehicle sensor including a passive sensor configured to receive and detect a first electromagnetic radiation from a guideway vehicle, an active sensor configured to transmit a second electromagnetic radiation and receive and detect the second electromagnetic radiation reflected from the guideway vehicle, and an unique identification code (ID) sensor that detects an ID associated with the guideway vehicle.

Some embodiments include a method for operating a guideway vehicle detection system having a multimodal guideway vehicle sensor having a passive sensor for detecting a guideway vehicle and producing sensor data, an active sensor for detecting a guideway vehicle and producing sensor data and an identification sensor for identifying a guideway vehicle and producing sensor data. The method includes receiving sensor data from passive sensor, the active sensor and the identification sensor. The method further includes detecting a first guideway vehicle with at least one of the passive sensor, the active sensor and the identification sensor. The method still further includes failing to detect the first guideway vehicle with one of the passive sensor, the active sensor and the identification sensor. The method further includes reducing a maximum amount of time for the multimodal guideway vehicle sensor to detect a second guideway vehicle.

One of ordinary skill in the art will recognize the operations of method 600 are merely examples and additional operations are includable, describe operations are removable and an order of operations are adjustable without deviating from the scope of method 600.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A multimodal guideway vehicle sensor, comprising:
- a passive sensor configured to receive and detect a first electromagnetic radiation from a guideway vehicle;
- an active sensor configured to transmit a second electromagnetic radiation and receive and detect the second electromagnetic radiation reflected from the guideway vehicle;
- an unique identification code (ID) sensor that detects an ID associated with the guideway vehicle; and
- a data fusion center configured to:
  - combine signals from the passive sensor, the active sensor and the ID sensor to produce guideway vehicle information about the guideway vehicle; and
  - resolve a conflict between two or more of the passive sensor, the active sensor, or the ID sensor based on a maximum time period for the detection of the guideway vehicle radiation or ID by one of the two or more of the passive sensor, the active sensor, or the ID sensor.

2. The multimodal guideway vehicle sensor of claim 1, wherein the first electromagnetic radiation is in the visible portion of the electromagnetic spectrum.

3. The multimodal guideway vehicle sensor of claim 1, wherein the first electromagnetic radiation is in the infrared portion of the electromagnetic spectrum.

4. The multimodal guideway vehicle sensor of claim 1, wherein the second electromagnetic radiation is coherent light in the visible or infrared portion of the electromagnetic spectrum emitted by the active sensor.

5. The multimodal guideway vehicle sensor of claim 1, wherein the second electromagnetic radiation is radar waves in the microwave portion or radio portion of the electromagnetic spectrum emitted by the active sensor.

6. The multimodal guideway vehicle sensor of claim 1, wherein the unique ID associated with the guideway vehicle is represented in a radio frequency identification (RFID) tag.

7. The multimodal guideway vehicle sensor of claim 1, wherein the unique ID associated with the guideway vehicle is represented in a pattern of metal objects.

8. The multimodal guideway vehicle sensor of claim 1, wherein the unique ID associated with the guideway vehicle is represented in a license plate.

9. The multimodal guideway vehicle sensor of claim 1, wherein the guideway vehicle information about the guideway vehicle includes at least one of: guideway vehicle type, guideway vehicle ID, guideway vehicle position, guideway vehicle speed, guideway vehicle travel direction, an elevation angle to the guideway vehicle, a heading angle of the guideway vehicle, and a video image of at least a portion of the guideway vehicle.

10. A guideway vehicle detection system, comprising:
- a wayside device; and
- a multimodal guideway vehicle sensor electrically coupled to the wayside device, the multimodal guideway vehicle sensor including
  - a passive sensor configured to receive and detect a first electromagnetic radiation from a guideway vehicle,
  - an active sensor configured to transmit a second electromagnetic radiation and receive and detect the second electromagnetic radiation reflected from the guideway vehicle,
  - an unique identification code (ID) sensor that detects an ID associated with the guideway vehicle, and a data fusion center configured to resolve a conflict between two or more of the passive sensor, the active sensor, or the ID sensor based on a maximum time period for the detection of the guideway vehicle radiation or ID by one of the two or more of the passive sensor, the active sensor, or the ID sensor.

11. The guideway vehicle detection system of claim 10, wherein the wayside device is positioned adjacent to an end point of a switch area having a guideway switch.

12. The guideway vehicle detection system of claim 11, wherein data from the multimodal guideway vehicle sensor causes the guideway switch to be deadlocked.

13. The guideway vehicle detection system of claim 12, wherein the multimodal guideway vehicle sensor is mounted onto the wayside device.

14. The guideway vehicle detection system of claim 10, wherein the multimodal guideway vehicle sensor is positioned adjacent to a platform having platform doors.

15. The guideway vehicle detection system of claim 14, wherein data from the multimodal guideway vehicle sensor causes the platform doors to be one of opened or closed.

16. The guideway vehicle detection system of claim 10, wherein the multimodal guideway vehicle sensor is positioned adjacent to one of an end point of a transition area.

17. A guideway vehicle detection system, comprising:

a wayside device; and a multimodal guideway vehicle sensor electrically coupled to the wayside device, the multimodal guideway vehicle sensor including a passive sensor configured to detect a first electromagnetic radiation from a guideway vehicle, an active sensor configured to transmit a second electromagnetic radiation and detect the second electromagnetic radiation reflected from the guideway vehicle, and a unique identification code (ID) sensor configured to detect an ID associated with the guideway vehicle, and a data fusion center configured to resolve a conflict between two or more of the passive sensor, the active sensor, or the ID sensor based on a maximum time period for the detection of the guideway vehicle radiation or ID by one of the two or more of the passive sensor, the active sensor, or the ID sensor.

18. The guideway vehicle detection system of claim 1, wherein the first electromagnetic radiation is in the infrared portion of the electromagnetic spectrum.

19. The guideway vehicle detection system of claim 1, wherein the second electromagnetic radiation is radar waves in the microwave portion or radio portion of the electromagnetic spectrum.

20. The guideway vehicle detection system of claim 1, wherein the unique ID associated with the guideway vehicle is represented in a pattern of metal objects.

* * * * *